US007824008B2

(12) United States Patent
Barger et al.

(10) Patent No.: US 7,824,008 B2
(45) Date of Patent: Nov. 2, 2010

(54) ELECTROSTATIC AEROSOL CONTROL

(75) Inventors: Denise Barger, Battle Ground, WA (US); Bradley B Branham, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 855 days.

(21) Appl. No.: 11/696,836

(22) Filed: Apr. 5, 2007

(65) Prior Publication Data

US 2008/0246803 A1 Oct. 9, 2008

(51) Int. Cl.
*B41J 2/165* (2006.01)

(52) U.S. Cl. ..... 347/34
(58) Field of Classification Search ..... 347/34
See application file for complete search history.

(56) References Cited

U.S. PATENT DOCUMENTS 6,592,211 B2 7/2003 Swenson
7,497,560 B2 * 3/2009 Endo ..... 347/76

* cited by examiner

*Primary Examiner*—Stephen D Meier
*Assistant Examiner*—Geoffrey Mruk

(57) ABSTRACT

In one embodiment, an aerosol trap for an inkjet printer includes a conductor at least partially surrounding ink ejection nozzles such that, when the conductor is charged, aerosol generated when ink is ejected from the nozzles is contained by the conductor, and a source of electric power operatively connected to the conductor.

13 Claims, 10 Drawing Sheets

ELECTROSTATIC AEROSOL CONTROL

BACKGROUND

The ejection of ink through the nozzles in an inkjet printer often produces tiny particles in addition to the relatively large ink drops. The ink drops have sufficient mass and momentum to carry them directly to the print medium at the desired location. The smaller particles that do not have sufficient mass or momentum to reach the print medium may remain suspended in the air, free to float in the air currents within the printer until settling on a surface. Such small particles are commonly referred to as ink aerosol. The presence of this aerosol and the residue from the aerosol settling on some of the surfaces in the printer can have undesirable effects. For example, salts in ink aerosol settling on electronic circuit components may corrode such components. Ink aerosol residue on moving parts in the printer, and the dust and debris it attracts, may increase friction or otherwise hamper performance. The buildup of aerosol on optical components used to detect and monitor the position and movement of a printhead, the carriage, or the print media may scatter, refract or block the light necessary for their proper operation. It is desirable, therefore, to control ink aerosol in an inkjet printer

DRAWINGS

DETAILED DESCRIPTION

Embodiments of the invention were developed in an effort to control ink aerosol in an inkjet printer. The invention is not limited to the embodiments shown in the figures and described below. These embodiments are examples only. Other embodiments may be made without departing from the spirit and scope of the invention which is defined in the Claims that follow this Description As used in this document: "aerosol" means small liquid or solid particles suspended in air; and "mesh" means an interwoven or intertwined structure.

Figure 1:
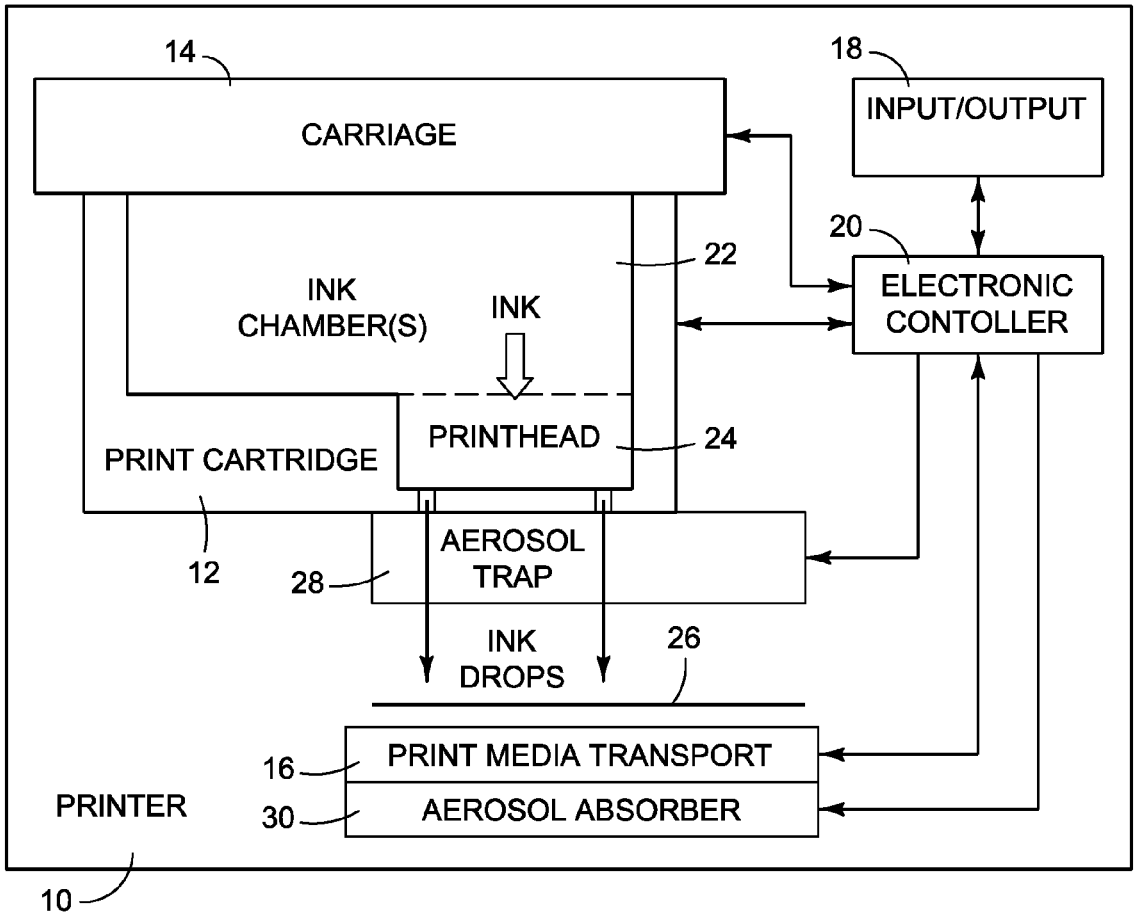
FIG. 1 is a block diagram illustrating an inkjet printer that includes an aerosol trap and an aerosol absorber according to one embodiment of the invention.

Referring to the block diagram of an inkjet printer 10 in FIG. 1, printer 10 includes a print cartridge 12, a carriage 14, a print media transport mechanism 16, an input/output device 18, and an electronic printer controller 20 connected to each of the operative components of printer 10. Print cartridge 12 includes one or more ink holding chambers 22 and a printhead 24. Printhead 24 represents generally a small electromechanical part that contains an array of miniature thermal resistors or piezoelectric devices that are energized to eject small droplets of ink out of an associated array of nozzles. A typical thermal inkjet printhead includes a nozzle plate arrayed with ink ejection nozzles and firing resistors formed on an integrated circuit chip positioned behind the ink ejection nozzles. The ink ejection nozzles are usually arrayed in columns along the nozzle plate. In operation, when printer controller 20 selectively energizes a firing resistor in the printhead, a vapor bubble forms in the ink vaporization chamber, ejecting a drop of ink through a nozzle on to the print media 26. In a piezoelectric printhead, piezoelectric elements are used to eject ink from a nozzle instead of firing resistors. Piezoelectric elements located close to the nozzles are caused to deform very rapidly to eject ink through the nozzles.

Print cartridge 12 may include a series of stationary cartridges or printheads that span the width of print media 26. Alternatively, cartridge 12 may include one or two cartridges that scan back and forth on carriage 14 across the width of media 26. Other cartridge or printhead configurations are possible. A movable carriage 14 may include a holder for cartridge 12, a guide along which the holder moves, a drive motor, and a belt and pulley system that moves the holder along the guide. Media transport 16 advances print media 26 lengthwise past cartridge 12 and printhead 24. For a stationary cartridge 12, media transport 16 may advance media 26 continuously past printhead 12. For a scanning cartridge 12, media transport 16 may advance media 26 incrementally past printhead 24, stopping as each swath is printed and then advancing media 26 for printing the next swath.

Controller 20 communicates with external devices through input/output device 18, including receiving print data from a computer or other host device. Controller 20 controls the movement of carriage 14 and media transport 16. Controller 20 is electrically connected to printhead 24 to energize the firing resistors to eject ink drops on to media 26. By coordinating the relative position of cartridge 12 and printhead 24 with media 26 and the ejection of ink drops, controller 20 produces the desired image on media 26 according to the print data received from a host device.

Printer 10 also includes an electrostatic aerosol trap 28 and an aerosol absorber 30. Aerosol trap 28 electrostatically traps, in the area around printhead 24, aerosol generated when ink drops are ejected through the nozzles in printhead 24. As described in more detail below, the conductors in trap 28 are configured to contain much of the aerosol generated during printing in the print zone, forcing many of the particles to collect on uncharged dielectrics. For example, aerosol trapped against the bottom of printhead 24 tends to collect on the uncharged dielectric material that surrounds the nozzle plate. Ink residue collecting in this area may be removed with the service station wiper commonly used in many inkjet printers. Aerosol absorber 30 electrostatically and mechanically absorbs aerosol that escapes trap 28 into an array of interconnected conductors positioned beneath the media path (for example, in the location occupied by porous mechanical absorbers used in conventional inkjet printers). As described in more detail below, the conductors in absorber 30 form a conductive mesh that helps create a non-uniform electric field extending across the print zone.

Figure 2:
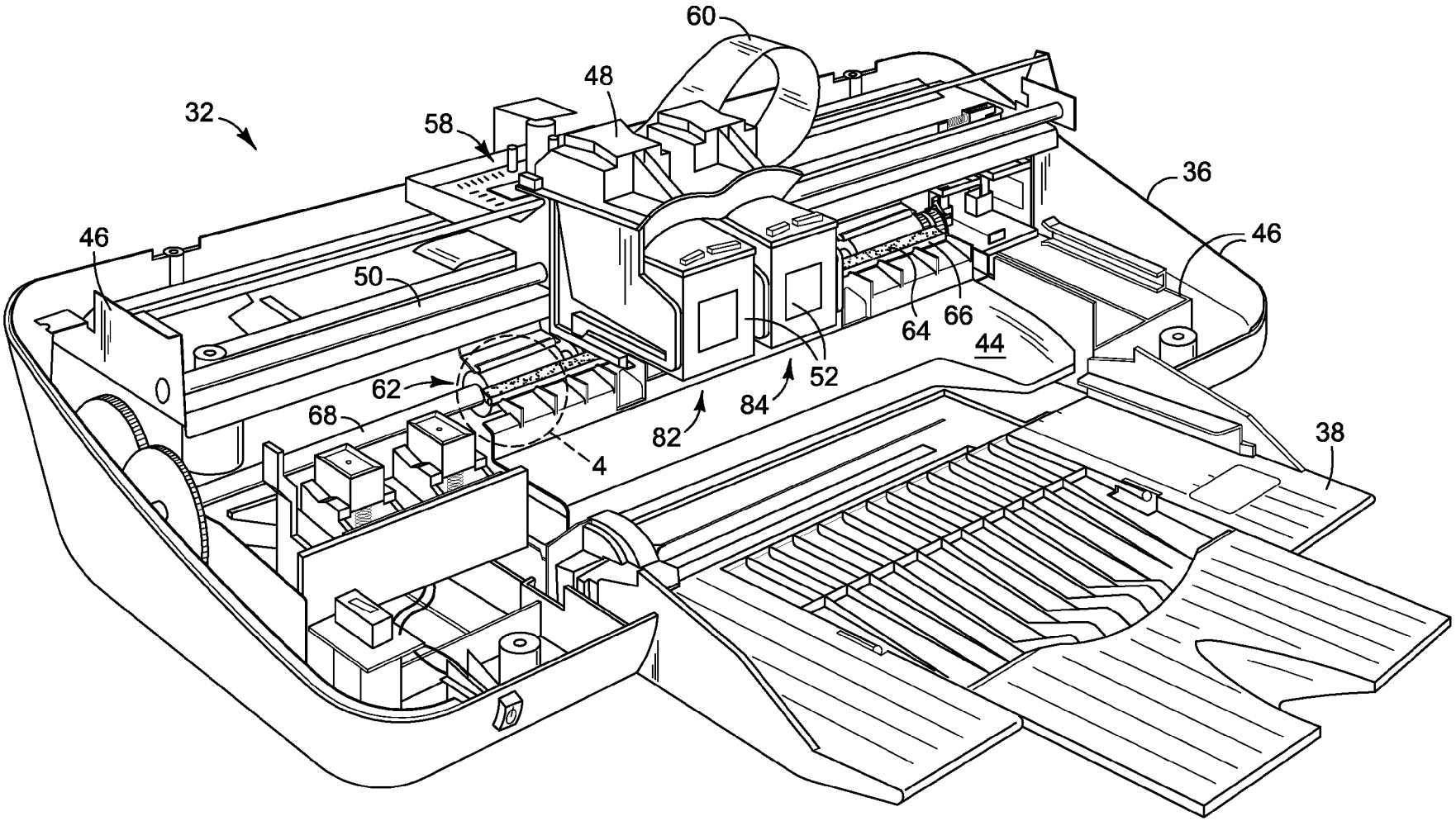
FIG. 2 is a perspective view of an inkjet printer such as the printer shown in the block diagram of FIG. 1.
Figure 3:
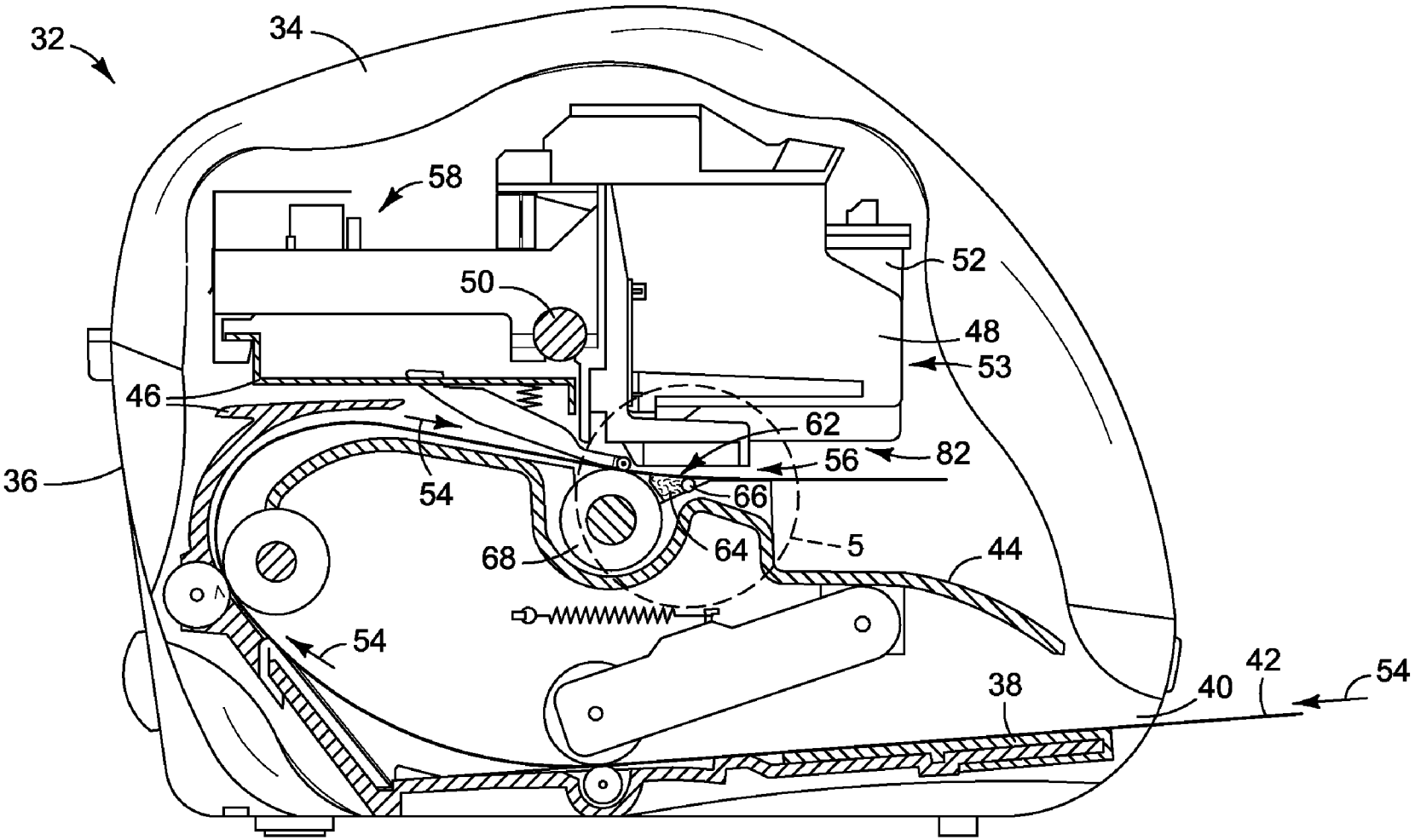
FIG. 3 is a side elevation and partial section view of the printer of FIG. 2.

FIGS. 2 and 3 illustrate an inkjet printer 32, such as printer 10 shown in the block diagram of FIG. 1. Printer 32 includes a cover 34 (FIG. 3) and a housing 36. Cover 34 is removed in FIG. 2 to expose the operative components of printer 32. A sheet media tray 38 is positioned at the bottom of printer 32 along an opening 40 in housing 36. Paper or other print media sheets 42 are stacked in tray 38 for input to printer 32 and printed sheets are output back through opening 40 over tray 38. A supporting surface 44 helps suspend the trailing edge of the printed sheets over tray 38. Printer 32 includes a chassis 46 that supports the operative components of printer 32. Chassis 46 represents generally those parts of housing 36 along with other structurally stable elements in printer 32 that support the operative components of printer 32. A printhead carriage 48 is driven back and forth along a guide rail 50 mounted to chassis 46. Any suitable drive mechanism may be used to move carriage 48. A reversing motor (not shown) coupled to carriage 48 through a belt and pulley system (not shown), for example, is one carriage drive mechanism commonly used in inkjet printers.

Carriage 48 has stalls 53 for holding ink cartridges 52. As best seen in FIG. 3, cartridges 52 are positioned along a media path 54 such that each sheet of print media 42 passes directly under cartridges 52 at print zone 56. As described above, the bottom of each cartridge 52, which faces media sheet 42, includes an array of nozzles through which drops of ink are ejected onto media sheet 42. An electronic printer controller 58 receives print data from a computer, scanner, digital camera or other image generating device. Controller 58 controls the movement of carriage 48 back and forth across media sheet 42 and the advance of media sheet 42 along media path 54. Printer controller 58 is also electrically connected to ink cartridges 52 through, for example, a flexible ribbon cable 60. As carriage 48 carries cartridges 52 across media sheet 42, printer controller 58 selectively activates ink ejection elements in cartridges 52 according to the print data to eject ink drops through the nozzles onto media sheet 42. By combining the movement of carriage 48 across media sheet 42 with the movement of sheet 42 along media path 54, controller 58 causes cartridges 52 to eject ink onto media sheet 42 to form the desired print image.

Figure 4:
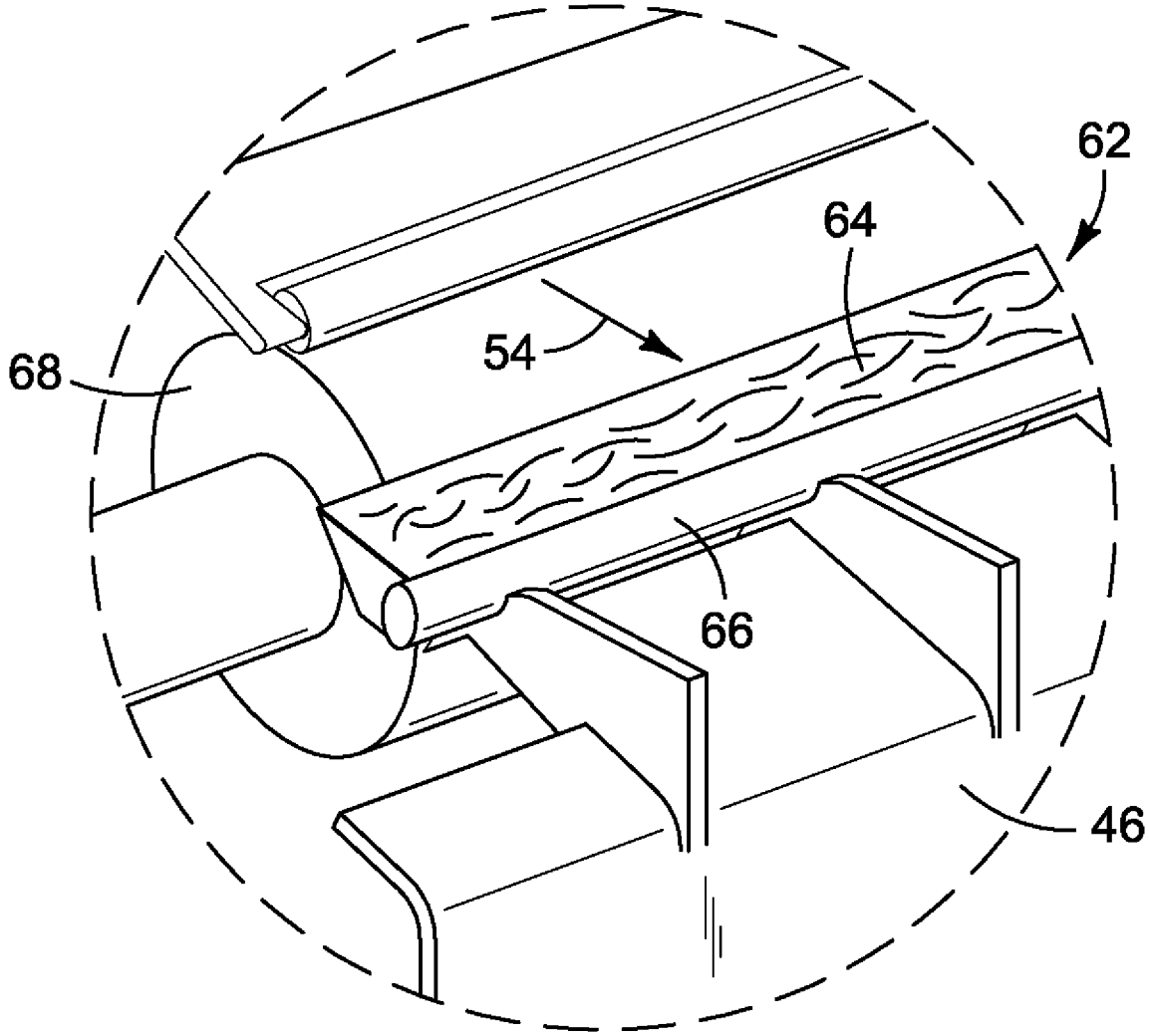
FIG. 4 is a detail perspective view of a portion of the media path taken from FIG. 2 showing the aerosol absorber.
Figure 5:
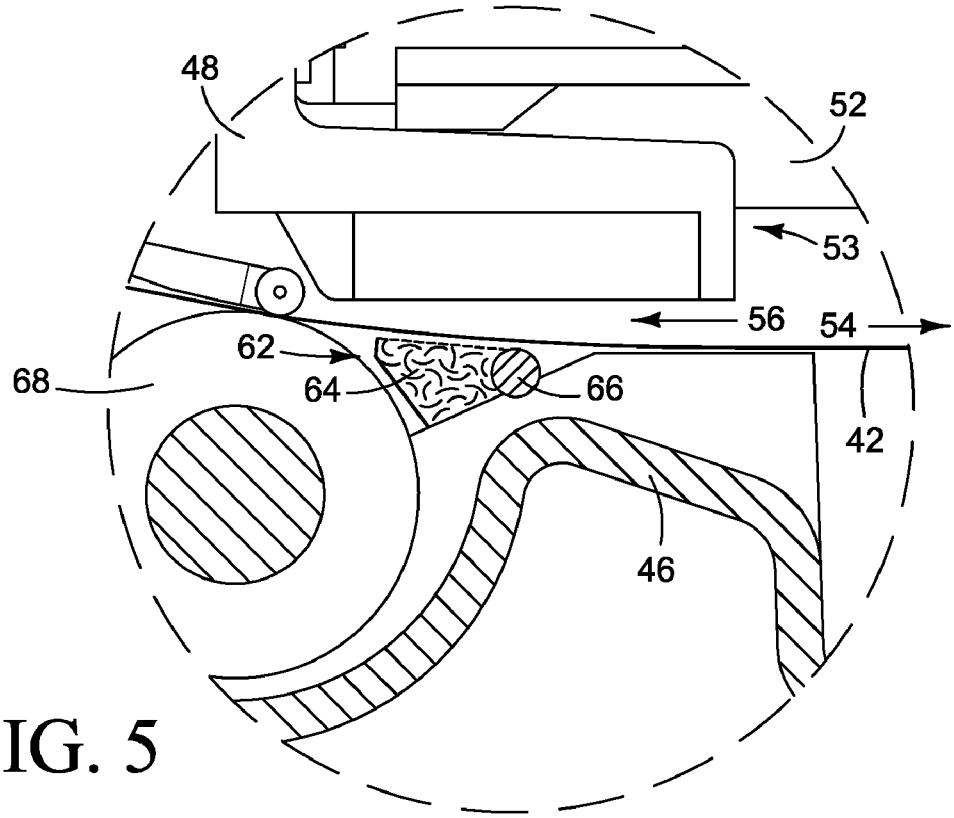
FIG. 5 is a detail view of a portion of the media path taken from FIG. 3 showing the aerosol absorber.

An ink aerosol absorber 62 is located just beneath media path 54 near print zone 56. Aerosol absorber 62 is shown in more detail in FIGS. 4 and 5. FIG. 4 is a close-up view of a portion of media path 54 taken from FIG. 2. FIG. 5 is a close-up view of a portion of media path 54 taken from FIG. 3. Referring now also to FIGS. 4 and 5, in the embodiment shown, absorber 62 is constructed as a conductive mesh 64 that spans the width of print zone 56. Mesh 64, having the consistency of steel wool for example, forms an array of interconnected conductors that functions as a mechanical absorber of ink aerosol and, when charged, as an electrostatic absorber of ink aerosol.

Figure 7:
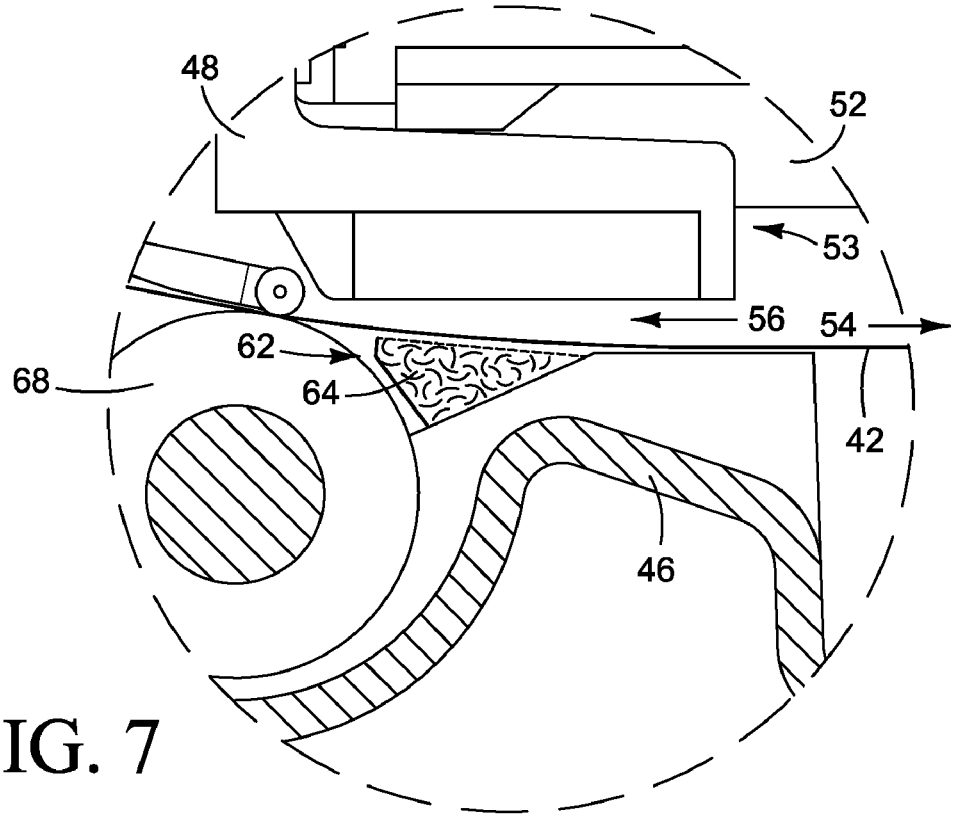
FIG. 7 is a detail view of a portion of the media path taken from FIG. 6 showing the aerosol absorber.
Figure 6:
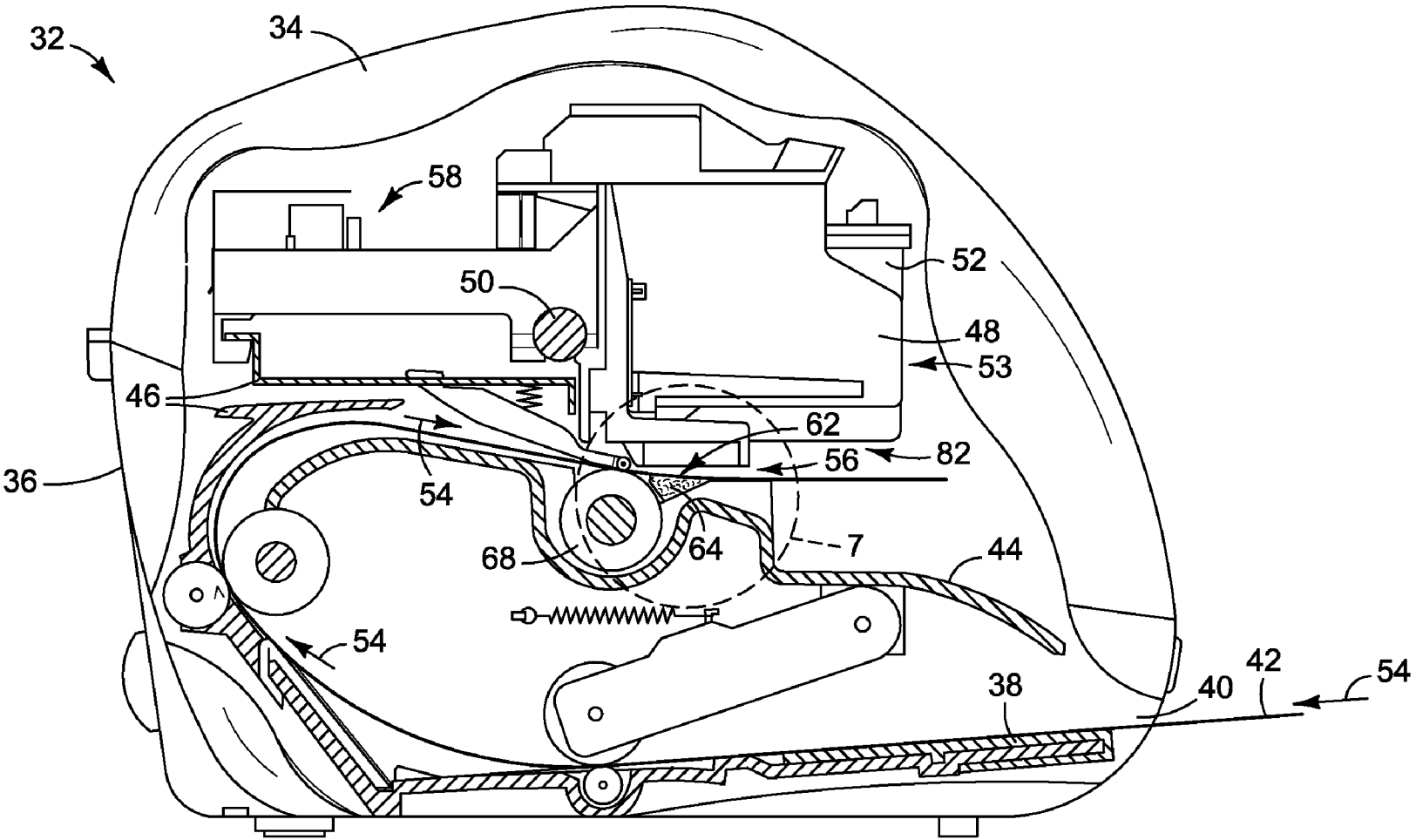
FIG. 6 is a side elevation and partial section view of a printer such as the printer shown in FIG. 2 showing an alternative embodiment of an aerosol absorber.

In the embodiment shown in FIGS. 4 and 5, an additional conductor, conductive rod 66 for example, is also located just beneath media path 54 near print zone 56. If conductor 66 and mesh 64 are in electrical contact with one another, through the mechanical contact shown in the figures for example, then a single power supply may be used to charge conductor 66 and mesh 64 and they will be charged to the same polarity and the same voltage. If conductor 66 and mesh 64 are not in electrical contact with one another, then they may be charged independently of one another to a different polarity and a different voltage. Conductor 66 is omitted from the embodiment shown in FIGS. 6 and 7. If an additional conductor is desired in the configuration of FIGS. 6 and 7, the segmented roller platen 68 may be charged to function in much the same way as conductor 66 in the embodiment of FIGS. 4 and 5.

Figure 8:
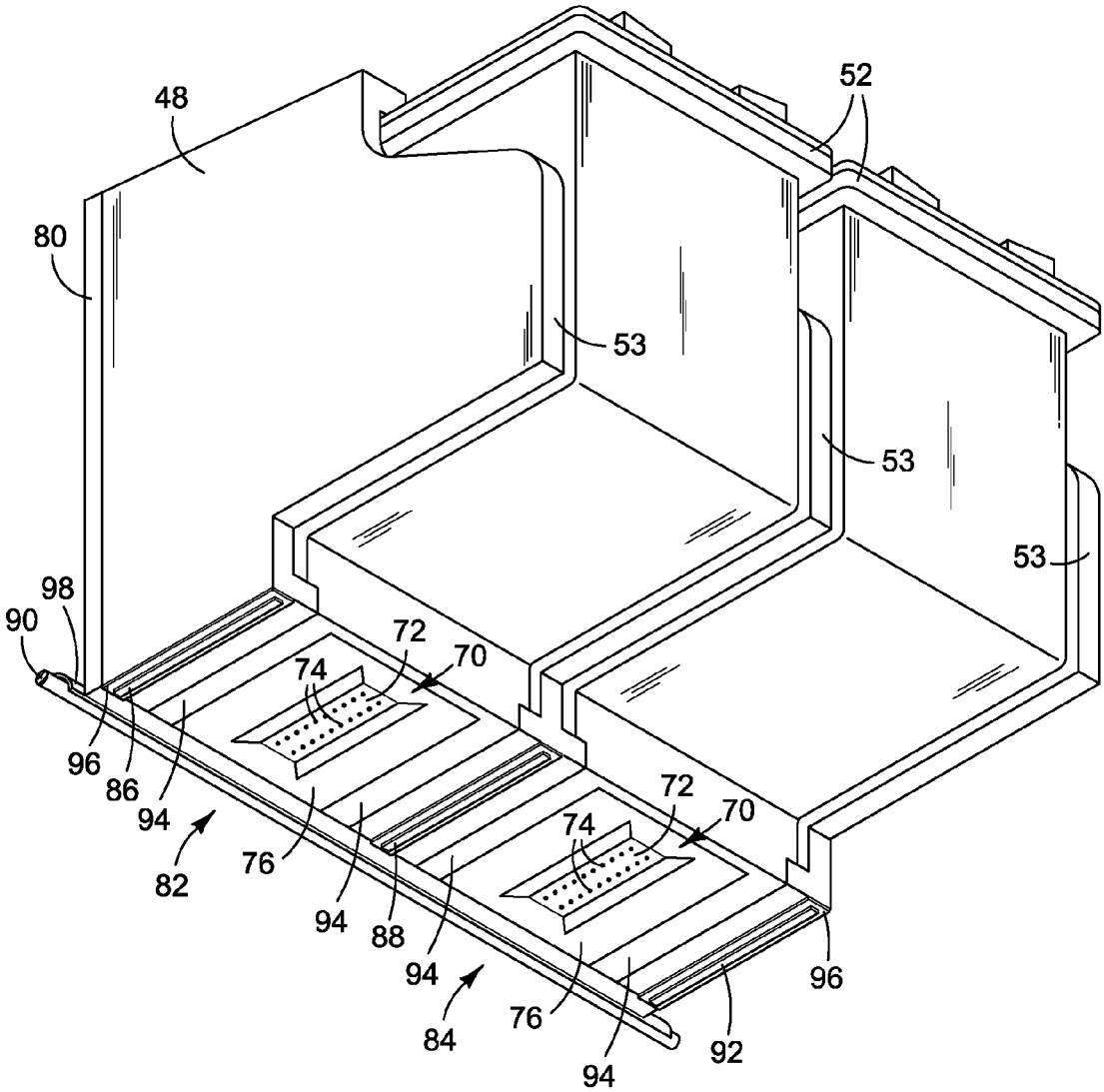
FIG. 8 is a perspective view of a portion of the carriage and print cartridges shown in FIG. 2.

FIG. 8 is a perspective view of a portion of carriage 48 and print cartridges 52 illustrating one exemplary embodiment of an aerosol trap. Referring to FIG. 8, each printhead 70 in cartridges 52 includes a nozzle plate 72 and an array of nozzles 74 through which ink is ejected on to print medium 42. An insulated tape 76 carries signal traces to printhead 70 from an array of contact pads 78 (shown in FIG. 9) on the front of each cartridge 52. Contact pads 78 on each print cartridge 52 contact an array of mating pads (not shown) on a circuit board 80 that is operatively connected to controller 58 through ribbon cable 60. Referring now also to FIGS. 3-6, an aerosol trap 82, 84 is located near each printhead 70. Each trap 82, 84 includes three conductors mounted on carriage stalls 53 partially surrounding a printhead 70. Trap 82 includes a left conductor 86, a right conductor 88, and a forward conductor 90. Trap 84 includes a left conductor 88, a right conductor 92 and a forward conductor 90. In the carriage/cartridge configuration shown, traps 82 and 84 share both conductor 88, positioned on carriage stalls 53 between the two cartridges 52, and conductor 90 positioned along the front of carriage stalls 53.

As described in more detail below, conductors 86-92 in traps 82 and 84 are configured to contain much of the aerosol cloud generated during printing, forcing many of the aerosol particles to collect on the uncharged dielectric material around printheads 70. For example, much of the aerosol trapped against the bottom of printheads 70 will collect on uncharged dielectric material 94 around each nozzle plate 72. The ink residue collecting in this area may be removed with a service station wiper during a typical cartridge servicing operation. In the embodiment shown in the figures, left and right conductors 86, 88 and 92 are flat while forward conductors 90 are cylindrical. Conductors with different cross-sectional geometries may help generate and intensify non-uniform electric fields in print zone 56. Each conductor may be insulated from the mounting part by, for example, insulating strips 96 under flat conductors 86, 88, and 92, and an insulating covering 98 on cylindrical conductor 90 (i.e. conductor 90 is an insulated wire).

Figure 9:
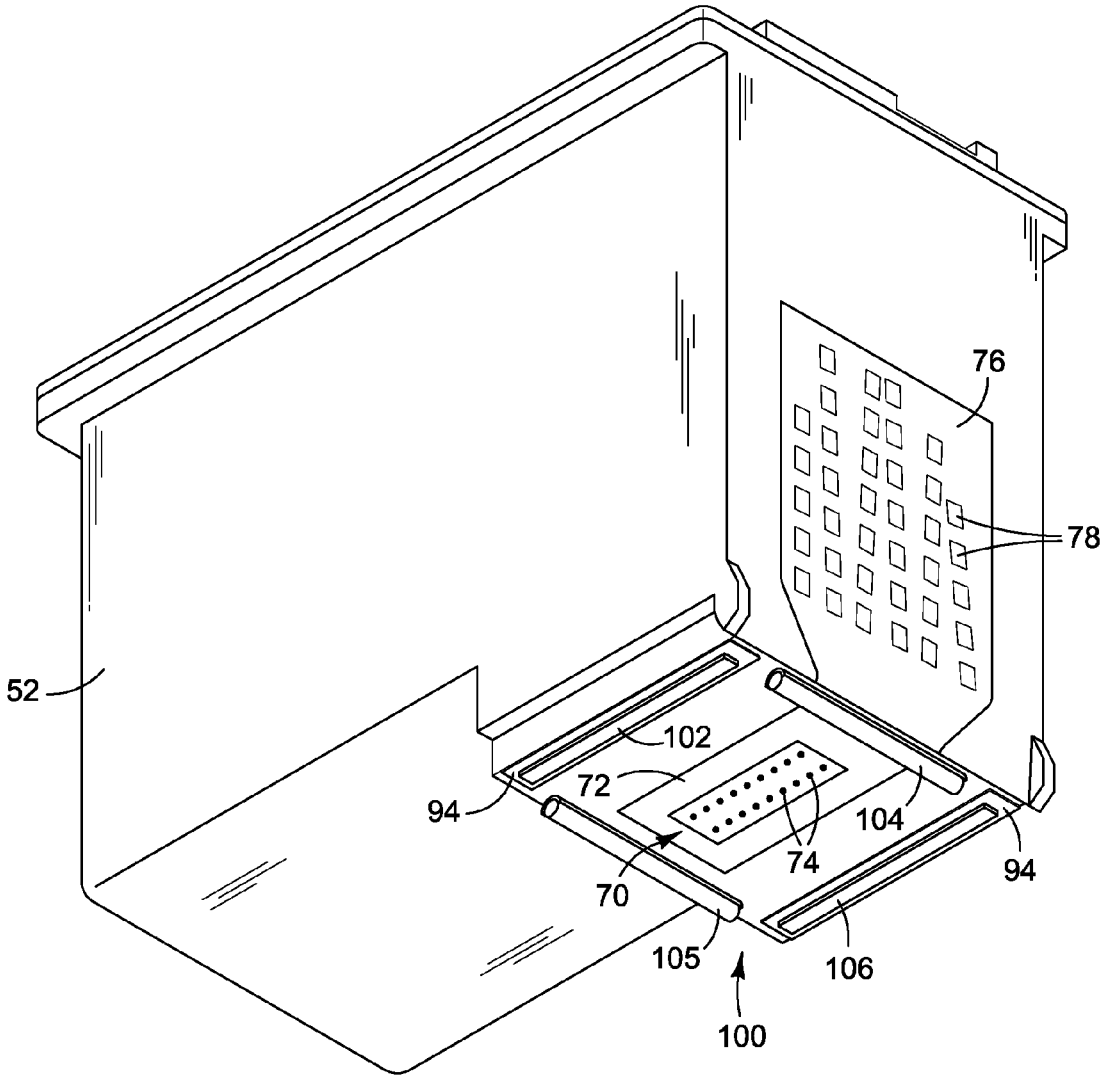
FIG. 9 is a perspective view of an ink cartridge illustrating an alternative embodiment of an aerosol trap.

In an alternative embodiment of an aerosol trap 100 shown in FIG. 9, the trap conductors 102, 104, 105 and 106 are mounted to print cartridge 52 (rather than to carriage stalls 53). As with traps 82 and 84 described above, the conductors 102-106 in trap 100 in FIG. 9 are configured to contain much of the aerosol generated during printing, forcing aerosol particles to collect on the uncharged dielectric material 94 around printhead 70. In this embodiment, however, conductors 102-106 substantially surround printhead 70. The configuration of the trap conductors may be varied as desirable for a particular printer configuration or printing environment. A single conductor 105 or 106 located at the front or rear of printhead 70 may be sufficient in some printer configurations while both conductors 105 and 106 may be desirable in other printer configurations.

Figure 10:
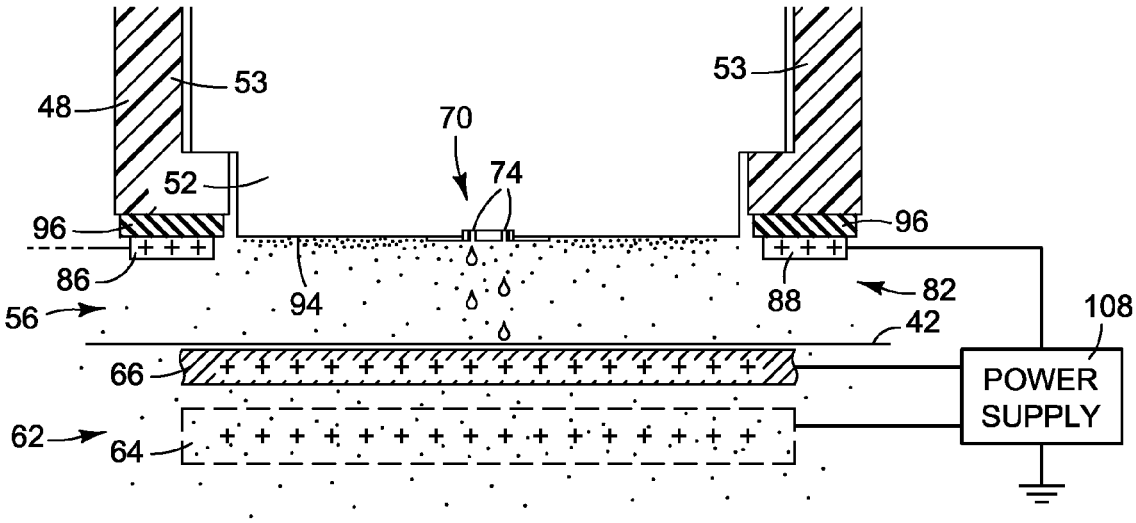
FIG. 10 illustrates ink aerosol in the print zone of a printer such as the printer shown in FIG. 2.
Figure 12:
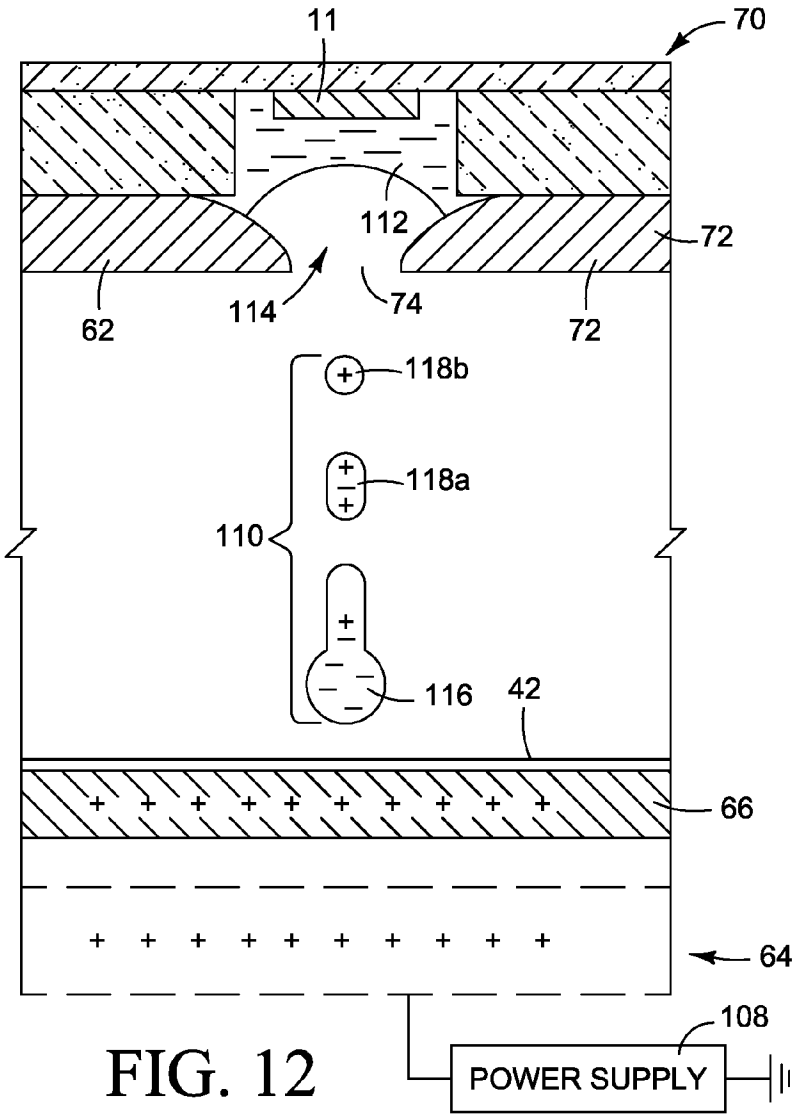
FIGS. 11 and 12 are detail views of print zone immediately adjacent to a printhead of a printer such as the printer shown in FIG. 2.
Figure 11:
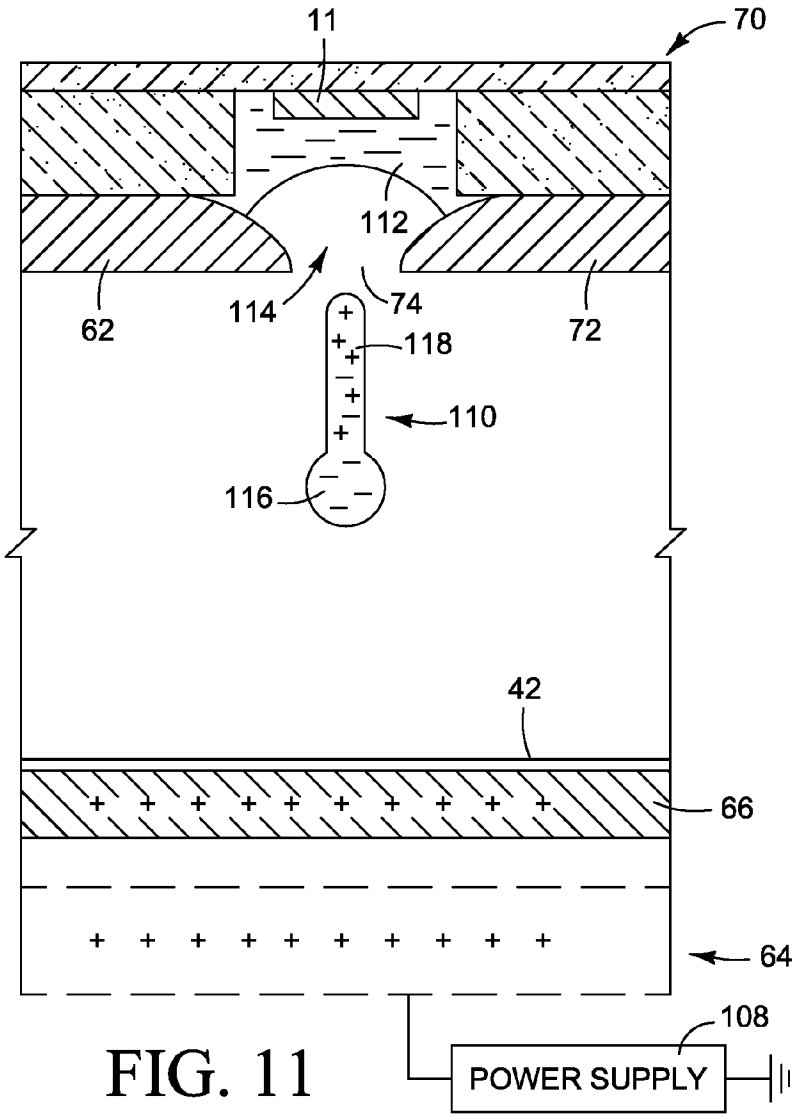

FIG. 10 illustrates the effect on ink aerosol in print zone 56 and media path 54 of absorber 62 and trap 82. FIGS. 11 and 12 are detail views of print zone 56 immediately adjacent to a printhead 70 that help to illustrate the physical mechanism through which absorber 62 and trap 82 are believed to act on the ink aerosol. Referring first to FIG. 10, trap conductors 86 and 88 on insulating strips 96 are mounted on carriage stall 53 adjacent to ink cartridge 52. Ink drops are ejected from nozzles 74 in printhead 70 toward media sheet 42. Conductor 66 and absorber mesh 64 are positioned beneath sheet 42. In the embodiment shown, trap conductors 86 and 88, conductor 66 and absorber mesh 64 are all connected to the same power supply 108 and charged to the same polarity.

Referring now also to FIGS. 11 and 12, an ink drop 110 ejected from a nozzle 74 in printhead 70 into an electric field is inductively charged due to electrophoretic migration of the solvated ions. The charged ions within ink drop 110 are not uniformly distributed. As shown in FIG. 11, due to the positively charged conductors 64 and 66, negative ions are concentrated at the head 116 of drop 110 while positive ions are concentrated near the tail 118 of drop 110. (The charge concentrations would be reversed for negatively charged conductors 64 and 66.) During the flight of drop 110 toward sheet 42, the tail 118 of drop 110 tends to break off into fragments 118*a* and 118*b*. The head 116 of ink drop 110 has sufficient mass and momentum to carry it to the surface of media sheet 42 to form part of the desired image. Smaller fragments 118*a* and 118*b* that do not have sufficient mass or momentum to reach the surface of sheet 42 remain suspended in print zone 56 as ink aerosol. Head 116 of ink drop 110 and the smaller fragments 118*a*, 118*b* may have a net charge or they may be electrically neutral. Electrically neutral ink aerosol particles have a balanced number of solvated ions. In a non-uniform electric field, the solvated ions polarize. The dielectrophoretic force accelerates the ink aerosol particles along the gradient of the non-uniform electric field.

Due to the Lorentz force, positively charged conductors 64 and 66 attract the predominantly negatively charged larger head particles 116 down toward the surface of sheet 42 while at the same time repelling the predominantly positively charged ink aerosol (e.g., smaller tail particles 118*a* and 118*b*) back toward the bottom of print cartridge 52. Referring to FIG. 10, the predominantly positively charged ink aerosol is also repelled by positively charged conductors 86 and 88 (and 90 which is not visible in FIG. 10), trapping ink aerosol near printhead 70 where it tends to collect on dielectric surfaces 94 and nozzle plate 72. Any negatively charged ink aerosol tends to collect on the positively charged conductors themselves.

In one embodiment, a method implemented in an inkjet printer includes ejecting ink from a printhead and electrostatically trapping, in an area around the printhead, ink aerosol generated during the ejecting. The act of electrostatically trapping, in an area around the printhead, ink aerosol generated during the ejecting may include surrounding the printhead with conductors and charging those conductors to the same polarity and/or exposing the ink aerosol to a non-uniform electric field. The method may also include absorbing ink aerosol generated during the ejecting into a conductive mesh extending along a print zone, preferably an electrically charged conductive mesh extending along the print zone.

In one embodiment, an inkjet printer includes: an ink cartridge having ink ejection nozzles positioned at a central portion of the surface; a carriage carrying the ink cartridge; a media path along which print media may be exposed to ink ejected through the nozzles; an array of interconnected conductors disposed beneath the media path and extending across the print zone; and an electronic controller operatively connected to the ink cartridge for selectively activating ink ejection elements in the cartridge and to the conductor for selectively charging the conductor. The array of interconnected conductors may comprise a conductive mesh. The printer may also include a conductive rod disposed beneath the print media path and extending across the print zone, the conductive rod being electrically connected to the array of interconnected conductors.

The present invention has been shown and described with reference to the foregoing exemplary embodiments. It is to be understood, however, that other forms, details and embodiments may be made without departing from the spirit and scope of the invention which is defined in the following claims.

What is claimed is:

1. An aerosol trap for an inkjet printer, comprising:

a first conductor positioned adjacent to ink ejection nozzles of a printer cartridge and at least partially surrounding the ink ejection nozzles on at least three sides;

a second conductor positioned adjacent to a media path, the media path being opposite the nozzles and extending across a print zone associated with the nozzles;

a dielectric surface, the dielectric surface being adjacent to the ink ejection nozzles on the printer cartridge; and a power source in circuit with the first and second conductors to charge the first and second conductors with a same polarity, aerosol generated when ink is ejected from the nozzles being repelled by the first conductor and attracted to the dielectric surface of the printer cartridge.

2. The trap of claim 1, wherein the first conductor comprises multiple conductor segments situated on respective sides of the nozzles.

3. The trap of claim 2, wherein the multiple conductors lie in substantially a same plane.

4. The trap of claim 1, wherein the second conductor comprises a conductive mesh.

5. The trap of claim 1, wherein the aerosol is substantially contained in an area around the nozzles, the area being defined by the first conductor.

6. An inkjet printer, comprising:

an ink cartridge having ink ejection nozzles and a dielectric surface adjacent to the ink ejection nozzles;

a carriage to carry the ink cartridge;

a media path along which print media is to be exposed to ink ejected from the nozzles, the interface between the ink cartridge and the media path defining a print zone through which ink ejected from the nozzles passes to impact the print media;

a first conductor positioned adjacent to the ink ejection nozzles and at least partially surrounding the ink ejection nozzles;

a second conductor positioned adjacent to the media path; and a power source in circuit with the first and second conductors to charge the first and second conductors with a same polarity, aerosol generated when ink is ejected from the nozzles being repelled by the first conductor and attracted to the dielectric surface of the ink cartridge.

7. The printer of claim 6, wherein the first conductor comprises multiple conductor segments positioned on respective sides of the nozzles.

8. The printer of claim 7, wherein the multiple conductors lie in substantially a same plane.

9. The printer of claim 6, wherein the first conductor is affixed to the carriage.

10. The printer of claim 6, wherein the second conductor comprises a conductive mesh.

11. The printer of claim 6, wherein the first conductor is mounted to the ink cartridge.

12. The printer of claim 6, wherein the carriage comprises a movable carriage operative at the direction of a controller to move the ink cartridge through the print zone over the media path to eject ink onto the print media.

13. The printer of claim 6, wherein the aerosol generated when the ink is ejected from the nozzles is substantially contained within the print zone, the print zone being defined by the first conductor.

* * * * *